US010726747B2

(12) United States Patent
Navarro

(10) Patent No.: US 10,726,747 B2
(45) Date of Patent: Jul. 28, 2020

(54) LABEL AND BUNDLING ASSEMBLY FOR USE WITH GOODS

(71) Applicant: Jorge Navarro, Diamond Bar, CA (US)

(72) Inventor: Jorge Navarro, Diamond Bar, CA (US)

( * ) Notice: Subject to any disclaimer, the term of this patent is extended or adjusted under 35 U.S.C. 154(b) by 0 days.

(21) Appl. No.: 16/058,532

(22) Filed: Aug. 8, 2018

(65) Prior Publication Data

US 2018/0350276 A1 Dec. 6, 2018

Related U.S. Application Data

(63) Continuation-in-part of application No. 15/262,763, filed on Sep. 12, 2016, now abandoned.

(51) Int. Cl.

| | |
|---|---|
| ***G09F 3/14*** | (2006.01) |
| ***B65C 7/00*** | (2006.01) |
| *B65B 13/02* | (2006.01) |
| *B65B 13/18* | (2006.01) |
| *B65B 27/10* | (2006.01) |

(52) U.S. Cl.

CPC ..... *G09F 3/14* (2013.01); *B65C 7/00* (2013.01); *B65B 13/022* (2013.01); *B65B 13/182* (2013.01); *B65B 27/10* (2013.01)

(58) Field of Classification Search

CPC ..... G09F 2003/0283; B65B 13/182
USPC ..... 40/637, 645, 664, 665
See application file for complete search history.

(56) References Cited

U.S. PATENT DOCUMENTS

| | | | | | |
|---|---|---|---|---|---|
| 2,362,092 | A * | 11/1944 | Phelps | D04D 9/04 | 40/604 |
| 2,799,104 | A * | 7/1957 | Griesinger | G09F 3/10 | 40/638 |
| 4,656,767 | A * | 4/1987 | Tarrant | G09F 3/04 | 174/112 |
| 5,778,583 | A * | 7/1998 | Larsen | G09F 3/14 | 40/637 |
| 2006/0086028 | A1* | 4/2006 | Vaughan | G09F 3/14 | 40/665 |
| 2006/0207132 | A1* | 9/2006 | Vaughan | G09F 3/14 | 40/310 |
| 2012/0198738 | A1* | 8/2012 | Olivarez | G09F 3/0295 | 40/316 |

* cited by examiner

*Primary Examiner* — Joanne Silbermann
(74) *Attorney, Agent, or Firm* — Sandra Thompson; Finlayson Toffer Roosevelt & Lilly LLP

(57) ABSTRACT

A label and bundling assembly is disclosed that includes a label having a first end and a second end, an attachment component having a first point, a second point, a top side and an underside comprising a waterproof adhesive, wherein the adhesive is fully coated on the underside, and a bunching component, wherein the first point of the attachment component is coupled with the second end of the label, wherein the bunching component is secured to the adhesive of the attachment component, and wherein the second point of the attachment component is brought around a portion of the bunching component and the underside of the second point of the attachment component is brought into contact with the underside of the first point, such that the first point, the second point, and the bunching component form a waterproof seal. Methods of using contemplated embodiments are also disclosed.

12 Claims, 10 Drawing Sheets

Prior Art Figure 1

Prior Art Figure 2

LABEL AND BUNDLING ASSEMBLY FOR USE WITH GOODS

This Continuation in Part patent application claims priority to U.S. Utility patent application Ser. No. 15/262,763, which was filed on Sep. 12, 2016 and is entitled "Label and Bundling Assembly for Use with Goods", which is commonly-owned and incorporated herein in its entirety by reference.

FIELD OF THE SUBJECT MATTER

The field of the subject matter is a label and bundling assembly for use with goods, specifically goods that should be or require bundling or bunching.

BACKGROUND

Farmers and packagers use a lot of different methods to hold and label produce that is sold in a bunch, such as kale, carrots, greens, asparagus and other produce. For example, some packagers use wire coated or wrapped by paper to hold the bunch together. Other packagers use rubber bands. Finally, some farmers and packagers use a label band that wraps around and holds the produce.

As mentioned, many farmers and packagers use wire or paper-coated wire to bunch or gather produce. They are wrapped around the bunches of produce and then a label needs to be applied to provide information about the produce and presumably a bar code or price. Labels may be inserted onto the wire in a couple of different ways. The first method of putting a label on the wire holder is to slip the label onto the wire before the wire is secured. In this instance, the label needs to be produced with a hole or loop where the wire can be passed through. The label will move around on the wire and can become tangled or can be ripped off of the wire holder.

In some embodiments, the paper or plastic-coated wire 110 has a label 120 attached to the plastic or paper coating 130, before it is cured, as shown in Prior Art FIG. 1. In these embodiments, it is very easy for the label 220 to become dislodged or ripped off of the wire holder 210, especially if the goods (not shown) get wet—as they might at a produce stand or grocery store where fresh produce is routinely sprayed with water or put on ice, as shown in Prior Art FIG. 2.

It would be desirable to have a labeling and bundling system wherein the first point, the second point and the bunching component are all adhered together, so that water cannot get into the loop. A design like this is not present in any of the conventional systems or products. As a matter of fact, Lowe et al. (U.S. Pat. No. 5,732,495) specifically shows only points of adhesive, and states that the bunching component doesn't even need to be adhered with the label. Vaughan (US Publication 2006/0086028) doesn't require that the bunching component (elastic band) be adhered with the label. Oliverez (US Publication 2012/0198738) clearly states that the second section—the section that goes around and is in contact with the wire—"exhibits no adhesive properties on either planar surface", which means that it does not contemplate a fully waterproof closed seal between the first point, the second point and the bunching component.

To this end, it would be desirable to produce a combination labeling and bundling assembly that is fully waterproof and sealed or can hold up to spray watering, where the label does not slide around, where the assembly can suitably bundle and hold bunched produce, and where the assembly is quick and easy to apply.

SUMMARY OF THE SUBJECT MATTER

A label and bundling assembly for goods is disclosed that includes a label having a first end and a second end, an attachment component having a first point, a second point, a top side and an underside comprising a waterproof adhesive, wherein the adhesive is fully coated on the underside, and a bunching component, wherein the first point of the attachment component is coupled with the second end of the label, wherein the bunching component is secured to the adhesive of the attachment component, and wherein the second point of the attachment component is brought around a portion of the bunching component and the underside of the second point of the attachment component is brought into contact with the underside of the first point, such that the first point, the second point, and the bunching component form a fully waterproof seal.

Methods of utilizing a label and bundling assembly for goods, include: providing a label having a first end and a second end, providing an attachment component having a first point, a second point, a top side, and an underside comprising an adhesive, providing a bunching component, coupling the first point of the attachment component with the second end of the label, securing the bunching component to the adhesive of the attachment component, bringing the second point of the attachment component around a portion of the bunching component, and contacting the underside of the second point of the attachment component with the adhesive.

Additional methods of utilizing a label and bundling assembly for goods, include: providing a label having a first end and a second end, providing an attachment component having a first point, a second point, a top side, and an underside comprising a waterproof adhesive, wherein the adhesive is fully coated on the underside, providing a bunching component, coupling the first point of the attachment component with the second end of the label, securing the bunching component to the adhesive of the attachment component, bringing the second point of the attachment component around a portion of the bunching component, and contacting the underside of the second point of the attachment component with the adhesive, such that the first point, the second point, and the bunching component form a fully waterproof seal.

A contemplated label and bundling assembly for use with any goods that are designed to be bunched. Contemplated goods include vegetables, fruits, pasta, artificial flowers, real flowers, fire starter sticks, pens, pencils, or highlighters.

BRIEF DESCRIPTION OF THE FIGURES

In some embodiments, the paper or plastic-coated wire has a label attached to the plastic or paper coating, before it is cured, as shown in Prior Art FIG. 1.

In these embodiments, it is very easy for the label to become dislodged or ripped off of the wire holder, especially if the goods get wet—as they might at a produce stand or grocery store where fresh produce is routinely sprayed with water or put on ice, as shown in Prior Art FIG. 2.

DETAILED DESCRIPTION

A combination labeling and bundling assembly for goods has been produced that is waterproof or can hold up to spray watering, where the label does not slide around, where the assembly can suitably bundle and hold bunched produce, and where the assembly is quick and easy to apply. A contemplated label and bundling assembly for use with any goods that are designed to be bunched. Contemplated goods include vegetables, fruits, pasta, artificial flowers, real flowers, fire starter sticks, pens, pencils, or highlighters.

Specifically, a label and bundling assembly, as disclosed herein, includes a label having a first end and a second end, an attachment component having a first point, a second point, and an underside comprising an adhesive, and a bunching component, wherein the first point of the attachment component is coupled with the second end of the label, wherein the bunching component is secured to the adhesive of the attachment component, and wherein the second point of the attachment component is brought around a portion of the bunching component and brought into contact with the adhesive.

In addition, a label and bundling assembly is disclosed that includes a label having a first end and a second end, an attachment component having a first point, a second point, a top side and an underside comprising a waterproof adhesive, wherein the adhesive is fully coated on the underside, and a bunching component, wherein the first point of the attachment component is coupled with the second end of the label, wherein the bunching component is secured to the adhesive of the attachment component, and wherein the second point of the attachment component is brought around a portion of the bunching component and the underside of the second point of the attachment component is brought into contact with the underside of the first point, such that the first point, the second point, and the bunching component form a fully waterproof seal.

Figure 6:
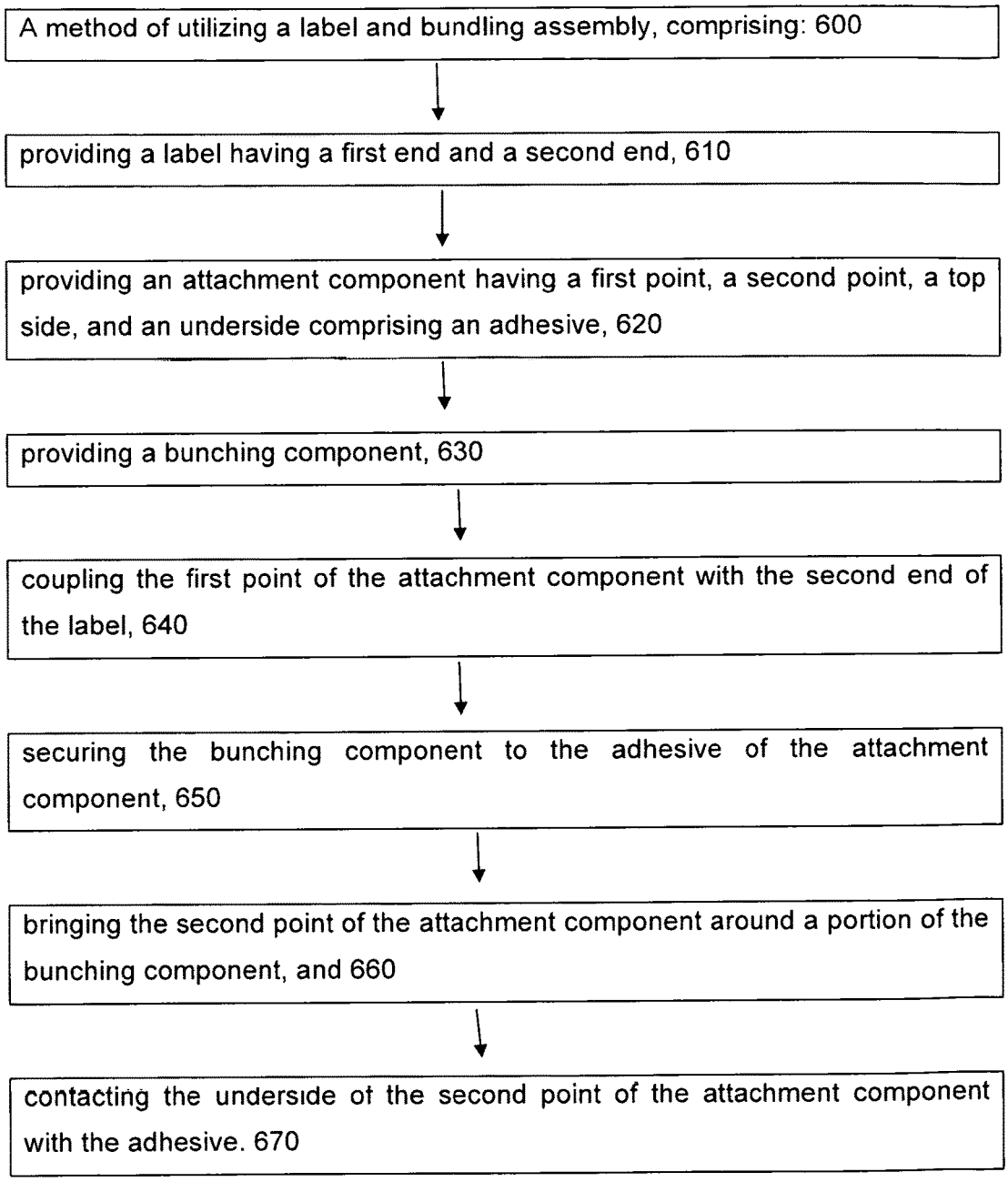
FIG. 6 shows a contemplated method.

Methods 600 of utilizing a label and bundling assembly, include and are shown in FIG. 6: providing a label having a first end and a second end 610, providing an attachment component having a first point, a second point, a top side, and an underside comprising an adhesive 620, providing a bunching component 630, coupling the first point of the attachment component with the second end of the label 640, securing the bunching component to the adhesive of the attachment component 650, bringing the second point of the attachment component around a portion of the bunching component 660, and contacting the underside of the second point of the attachment component with the adhesive 670.

Additional methods of utilizing a label and bundling assembly for goods, include: providing a label having a first end and a second end, providing an attachment component having a first point, a second point, a top side, and an underside comprising a waterproof adhesive, wherein the adhesive is fully coated on the underside, providing a bunching component, coupling the first point of the attachment component with the second end of the label, securing the bunching component to the adhesive of the attachment component, bringing the second point of the attachment component around a portion of the bunching component, and contacting the underside of the second point of the attachment component with the adhesive, such that the first point, the second point, and the bunching component form a fully waterproof seal.

Figure 3:
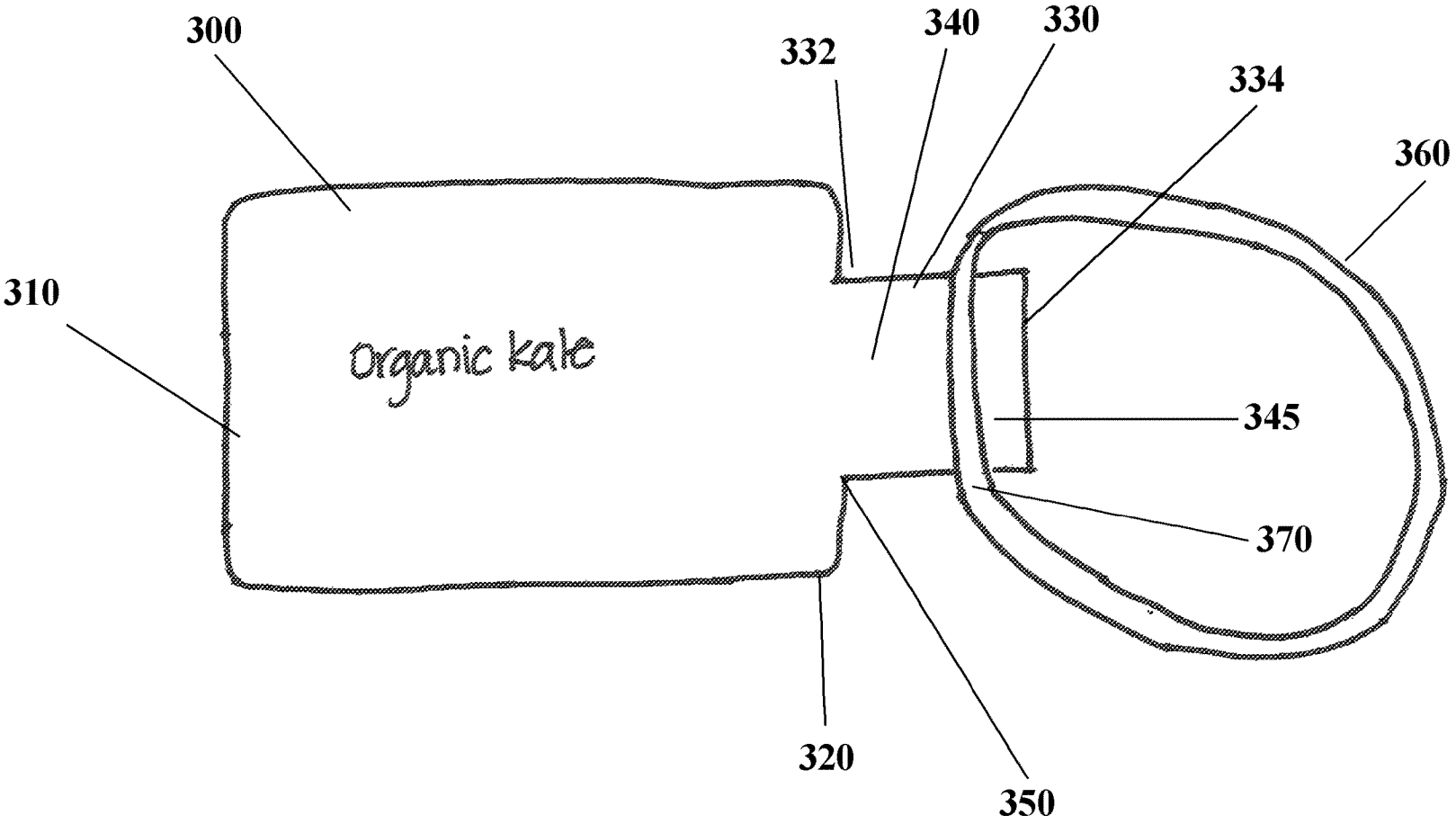
FIG. 3 shows a contemplated embodiment.

Contemplated labels are generally square or rectangular but may be any suitable shape. For the purposes of this disclosure, contemplated labels 300 have a first end 310 and a second end 320, as shown in FIG. 3. Contemplated labels may be made from any suitable material or materials and may be coated to provide a waterproof surface or to enhance the waterproof characteristic of the original material. Contemplated labels may include any number of pieces of information, including type of goods, identifying codes or bar codes, pricing, origin, organic designation and other labeling information and requirements.

An attachment component having a first point 332, a second 334 point and an underside 340 is also contemplated. The first point 332 of the attachment component 330 is coupled with the second end 320 of the label 300 at a point 350. The term "coupled" means, for the purposes of this disclosure, that the two items may be joined together manually by using adhesive or other joining methods or they may be joined together naturally because they are made from the same material. A contemplated attachment component is shown in FIG. 3 as well. In this instance, it is a natural extension of the label, because they are both cut or formed from the same material, as shown.

Contemplated attachment components comprise an underside 340 that has an applied or embedded adhesive 345 coated on it. A contemplated underside is designed to the be inside of a loop (shown in FIG. 4) that is eventually formed by the attachment component 330, when it is fully engaged. Contemplated adhesives may comprise any suitable adhesive, as long as the adhesive is relatively waterproof and able to adhere two similar surfaces when faced with exposure to the elements, such as temperature fluctuations, water, humidity (or lack of humidity), and shift or movement.

Figure 1:
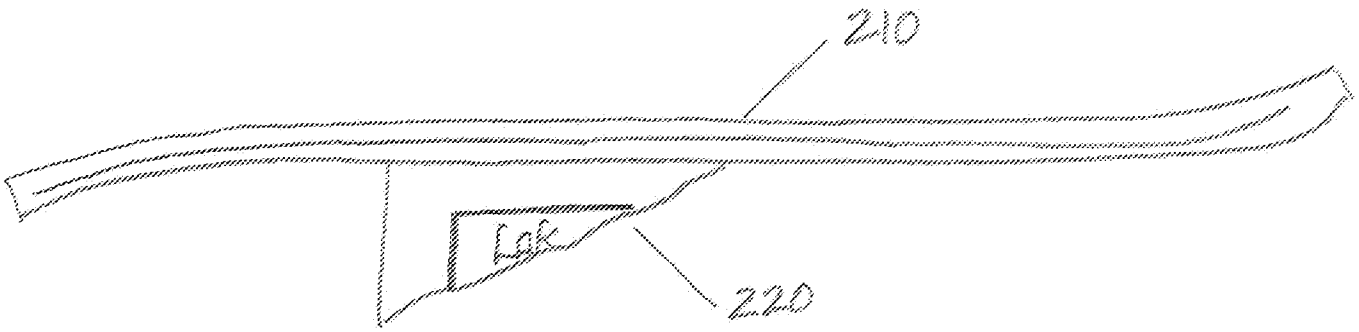
Figure 2:
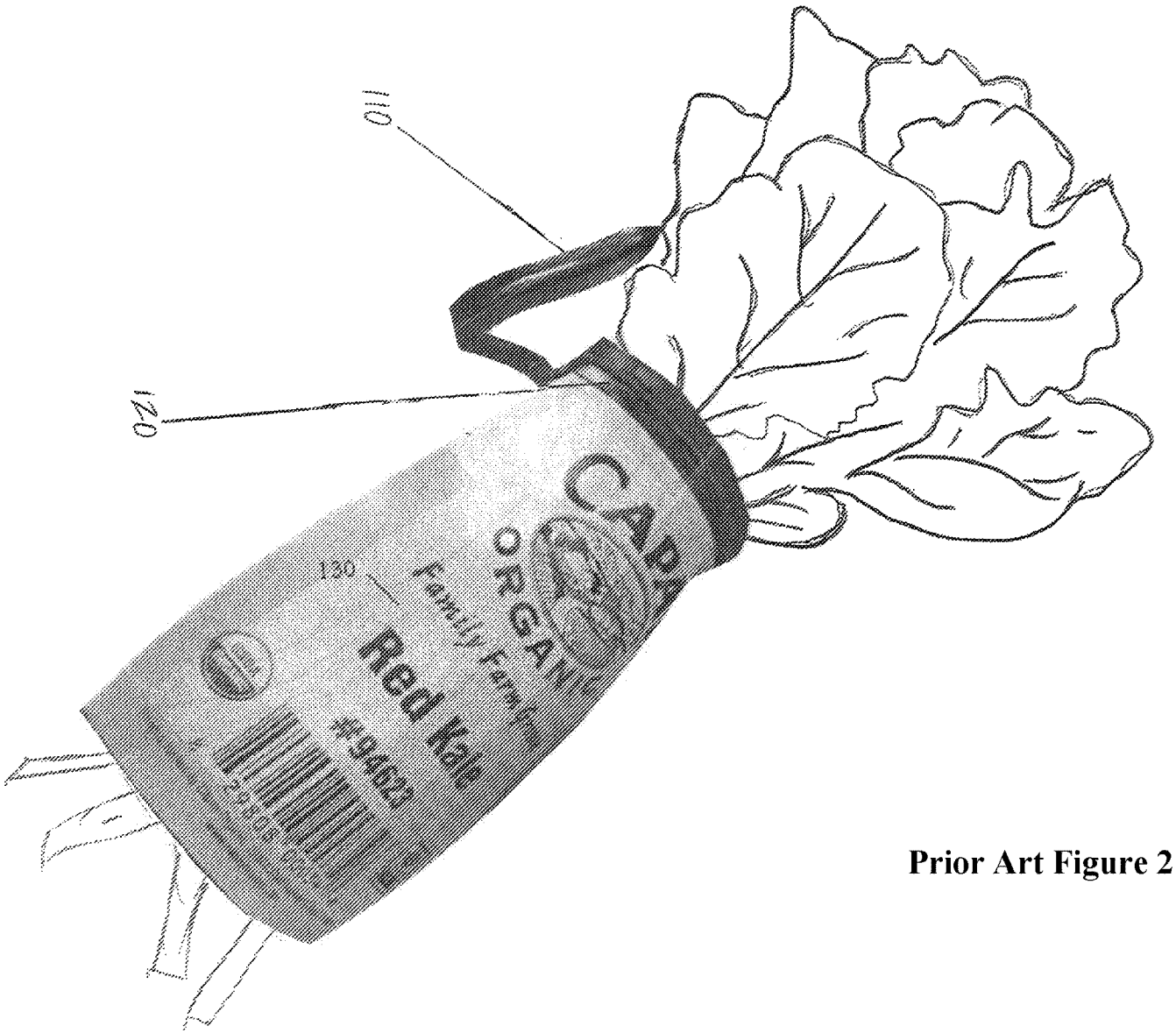

Contemplated assemblies have a bunching component 360, which is the component that contacts the label 300 at the attachment component point and also bundles, bunches or holds together the produce, products or goods (shown in Prior Art FIG. 1). Contemplated bunching components are designed to be easy to use and flexible, such as rubber bands, wires or coated wires, but may comprise any suitable material, as long as it is able to adhere to the adhesive on the attachment component, hold together bunched goods and be relatively easy to use by packers or farmers.

Figure 4:
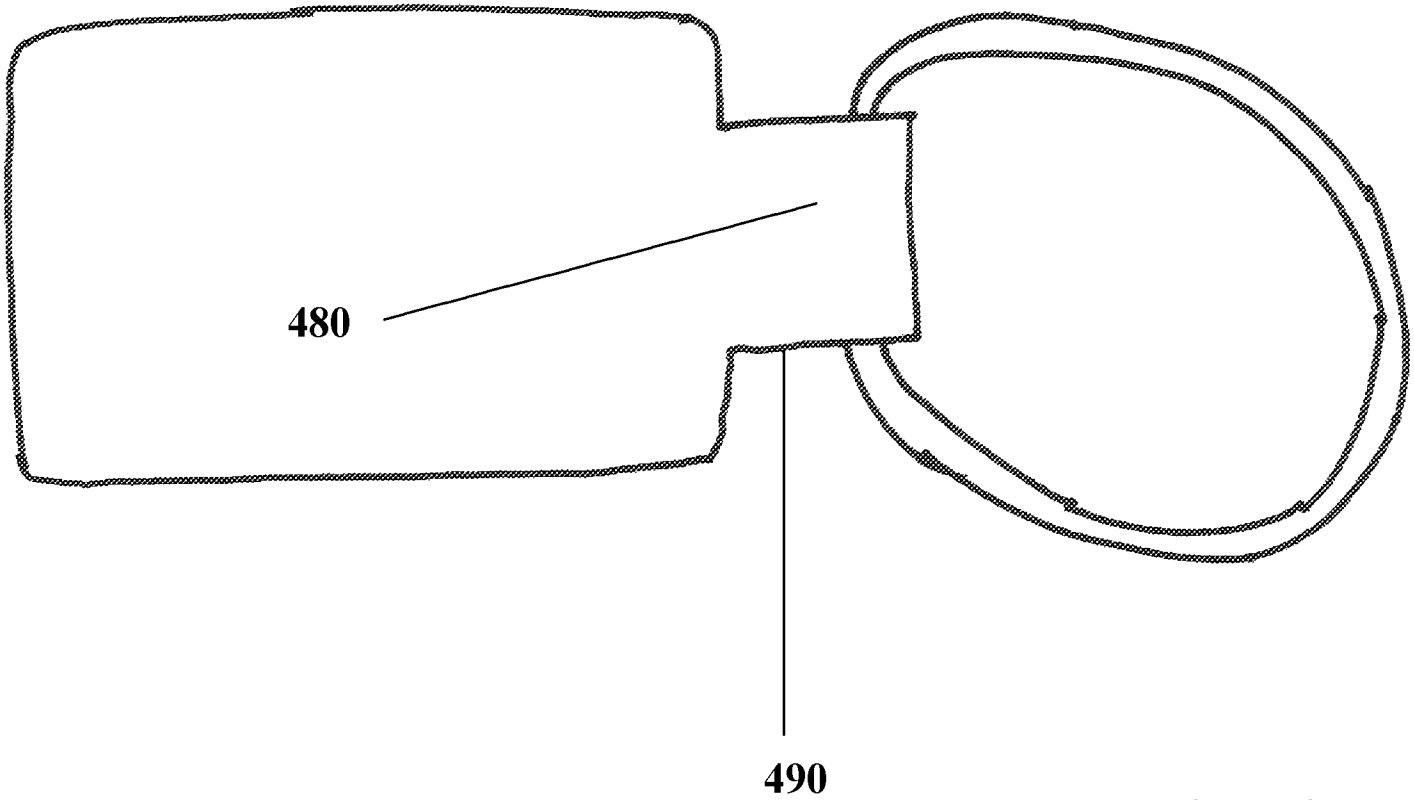
FIG. 4 shows a contemplated embodiment.
Figure 5:
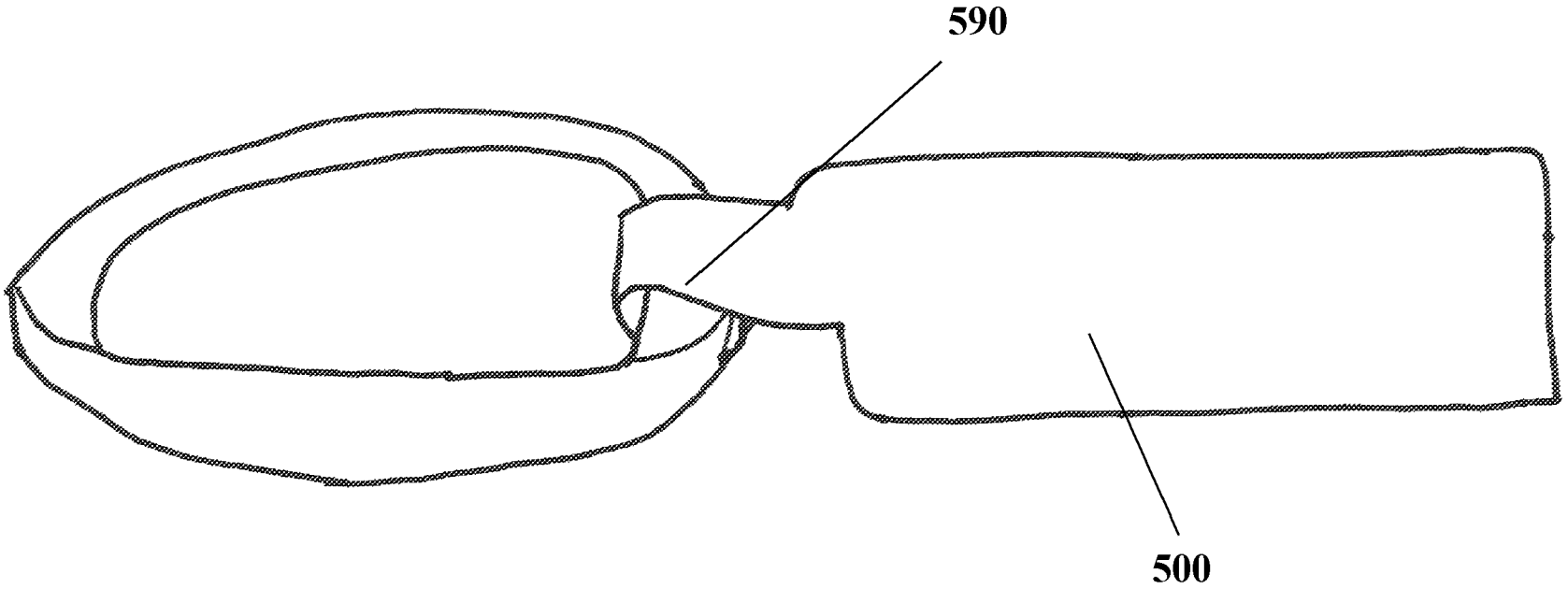
FIG. 5 shows a side view of a contemplated embodiment.

To produce a contemplated assembly, the bunching component is adhered to the adhesive on the underside of the attachment component, thus securing the label to the bunching component at a secure point 370. Then, the second end of the attachment component is looped (490) over the bunching component and brought back into contact with the adhesive on the underside of the attachment component at a point 480, as shown in FIG. 4. A side profile of the label 500 and the loop 590 is shown in FIG. 5. Reference number 590 is also pointing to the top side of the attachment component, which is the opposite of the underside where the adhesive is applied. Note that the bunching component is now partially located inside the loop 490. At this point, the bunching component is unable to move in relation to the label and the label is secure and unable to be ripped from the goods. It should be clear how this design addresses and overcomes many of the problems discussed in the background section.

Figure 9:
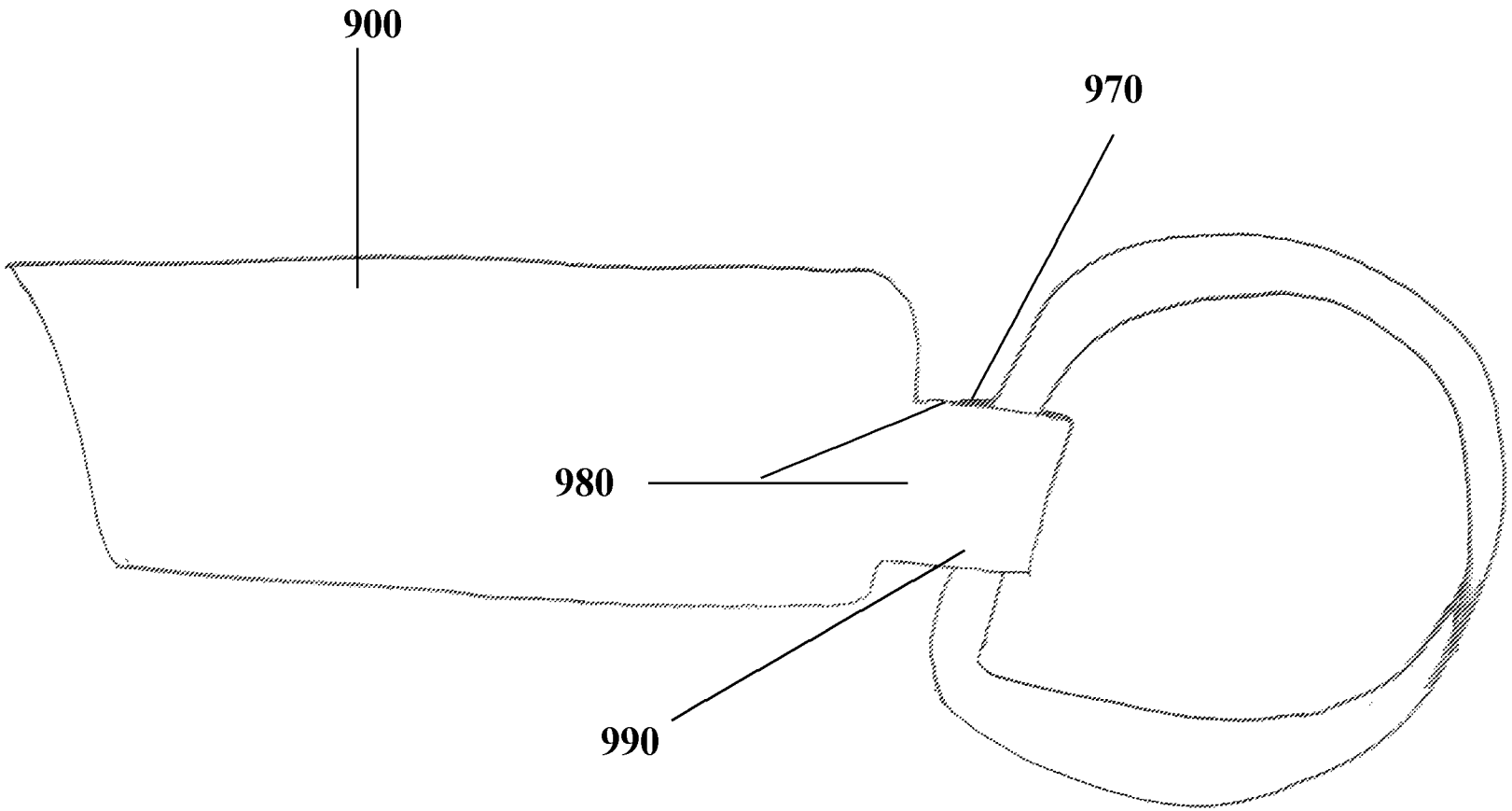
FIG. 9 shows a contemplated embodiment.

Another contemplated embodiment that differs from the one shown in FIG. 5 is shown in FIG. 9, which shows a side profile of the label 900 and the waterproof seal. Reference number 990 is also pointing to the top side of the attachment component, which is the opposite of the underside where the adhesive is applied. Note that the bunching component is now partially located inside the loop 990. At this point, the bunching component is unable to move in relation to the label and the label is secure and unable to be ripped from the goods. It should be clear how this design addresses and overcomes many of the problems discussed in the background section. The waterproof adhesive 970 fully seals and renders fully waterproof the seal area 980.

Figure 10:
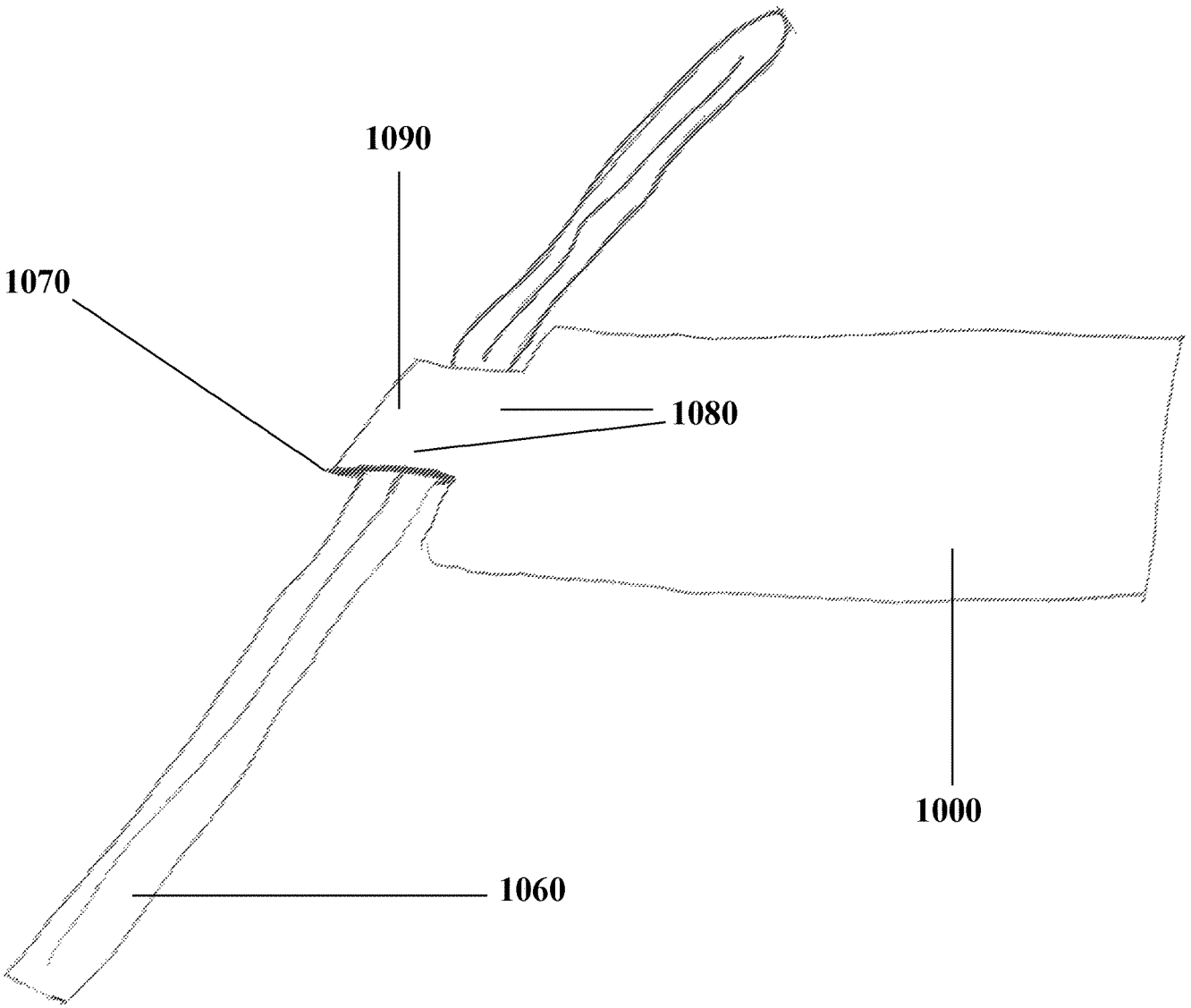
FIG. 10 shows a contemplated embodiment.

Another contemplated embodiment that differs from the one shown in FIG. 5 is shown in FIG. 10, which shows a side profile of the label 1000 and the waterproof seal. Reference number 1090 is also pointing to the top side of the attachment component, which is the opposite of the underside where the adhesive is applied. Note that the bunching component 1060 is now partially located inside the loop 1090. At this point, the bunching component is unable to move in relation to the label and the label is secure and unable to be ripped from the goods. It should be clear how this design addresses and overcomes many of the problems discussed in the background section. The waterproof adhesive 1070 fully seals and renders fully waterproof the seal area 1080.

Figure 7:
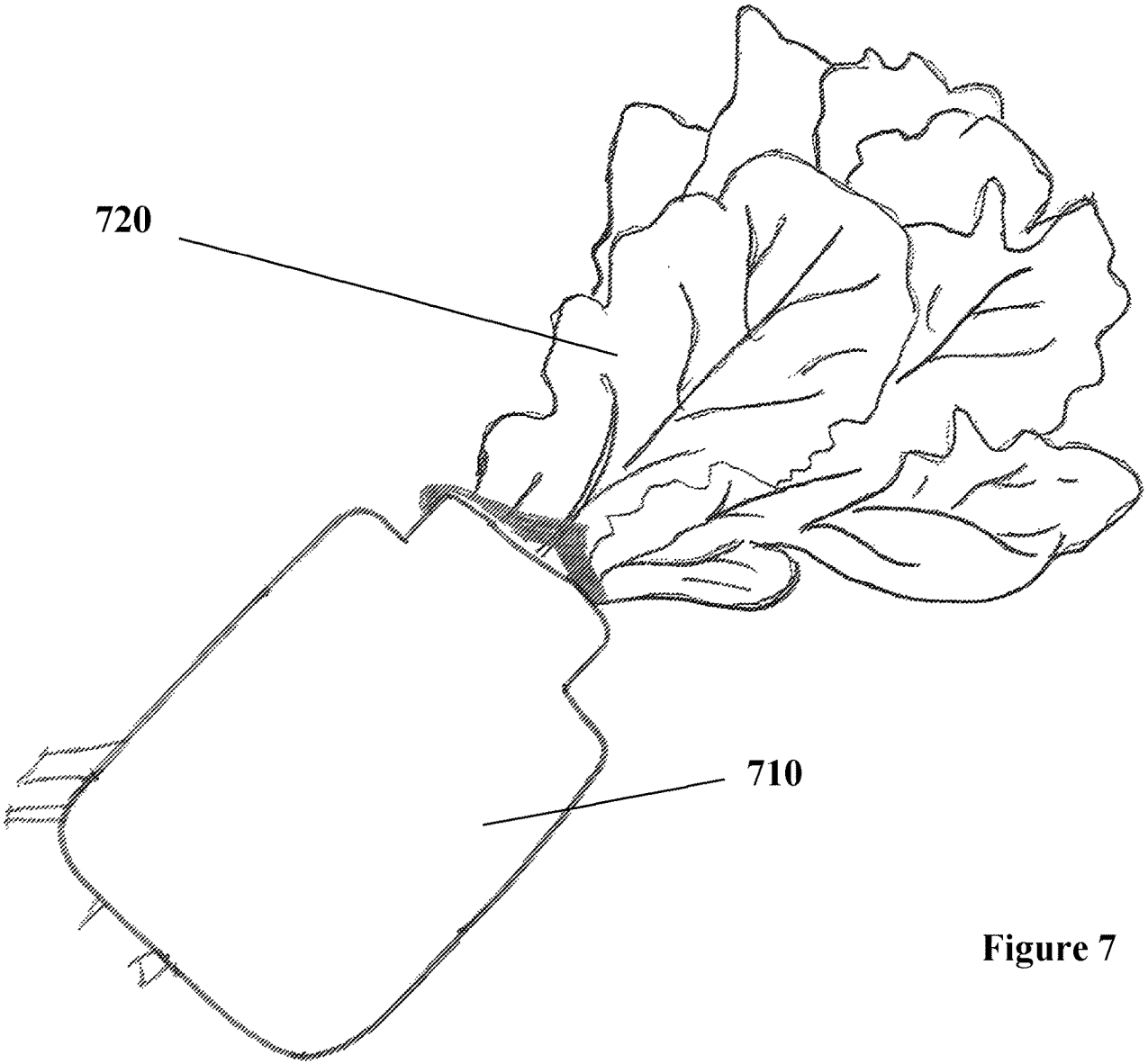
FIG. 7 shows a contemplated embodiment with goods.
Figure 8:
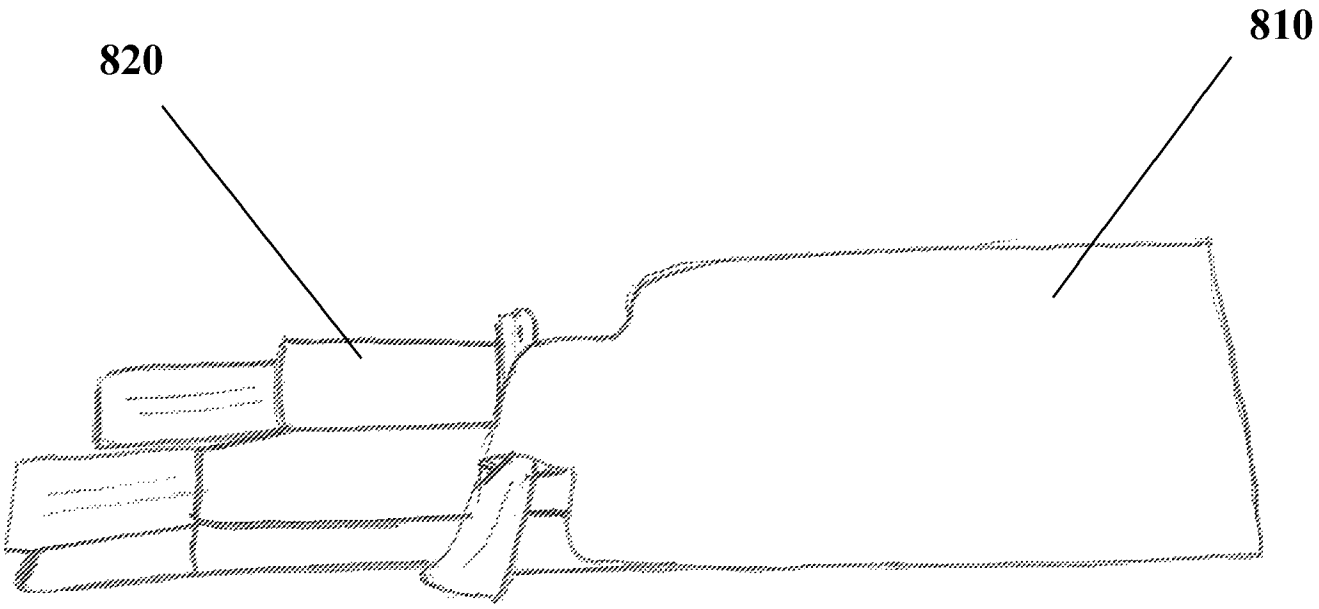
FIG. 8 shows a contemplated embodiment with goods.

FIGS. 7 and 8 show a contemplated label and bundling assembly 710 and 810, respectively, surrounding goods 720 and 820. In this case the goods are kale 720 and highlighters/pens 820.

It should be understood that the waterproof seal is between the label, the attachment component, and the bunching component. In other words, the bunching component is stationary with respect to the label and there is a fully waterproof seal that encompasses and includes the label, the attachment component and the bunching component, so that no water or moisture can get in the space between the bunching component and the label.

As mentioned earlier, a contemplated label or bundling assembly has a bunching component that is adhesively attached to the attachment component of a label to produce a waterproof seal when the attachment component, that has an underside coated with adhesive, is engaged with the bunching component. It should be clear that the underside of the attachment component is coated with adhesive, that the bunching component is engaged with that adhesive, and that the entire label and bundling assembly is waterproof. In this current application, the first point, the second point and the bunching component are all adhered together, so that water cannot get into the loop. This design is not present in any of the conventional systems or products. As a matter of fact, Lowe et al. (U.S. Pat. No. 5,732,495) specifically shows only points of adhesive, and states that the bunching component doesn't even need to be adhered with the label. Vaughan (US Publication 2006/0086028) doesn't require that the bunching component (elastic band) be adhered with the label.

Thus, specific embodiments, methods of label and bundling assemblies for goods have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the specification and claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. A label and bundling assembly for goods, comprising:

a label having a first end and a second end, an attachment component having a first point, a second point, a top side and an underside comprising a waterproof adhesive, wherein the adhesive is fully coated on the underside, wherein the attachment component is an extension of the label and the attachment component and the label are formed from the same material; and a bunching component, wherein the first point of the attachment component is coupled with the second end of the label, wherein the bunching component is secured to the adhesive of the attachment component, and wherein the second point of the attachment component is brought around a portion of the bunching component and the underside of the second point of the attachment component is brought into contact with the underside of the first point, such that the first point, the second point, and the bunching component form a fully waterproof seal that encompasses and includes the label, the attachment component and the bunching component, so that no water or moisture can get in the space between the bunching component and the label.

2. The label and bundling assembly of claim 1, wherein the bunching component comprises at least one rubber band, at least one wire, or at least one coated wire.

3. The label and bundling assembly of claim 1, wherein the bunching component comprises at least one rubber band.

4. The label and bundling assembly of claim 1, wherein the label and the attachment component comprise waterproof material.

5. The label and bundling assembly of claim 1, wherein the label and the attachment component comprise paper.

6. The label and bundling assembly of claim 1, wherein the label and the attachment component comprise coated paper.

7. The label and bundling assembly of claim 1, wherein the goods include vegetables, fruits, pasta, artificial flowers, real flowers, fire starter sticks, pens, pencils, or highlighters.

8. A method of utilizing a label and bundling assembly for goods, comprising:

providing a label having a first end and a second end, providing an attachment component having a first point, a second point, a top side, and an underside comprising a waterproof adhesive, wherein the adhesive is fully coated on the underside, wherein the attachment component is an extension of the label and the attachment component and the label are formed from the same material;

providing a bunching component, coupling the first point of the attachment component with the second end of the label, securing the bunching component to the adhesive of the attachment component, bringing the second point of the attachment component around a portion of the bunching component, and contacting the underside of the second point of the attachment component with the adhesive, such that the first point, the second point, and the bunching component form a fully waterproof seal that encompasses and includes the label, the attachment component and the bunching component, so that no water or moisture can get in the space between the bunching component and the label.

9. The method of claim 8, wherein the bunching component comprises at least one rubber band, at least one wire, or at least one coated wire.

10. The method of claim 8, wherein the bunching component comprises at least one rubber band.

11. The method of claim 8, wherein the label and the attachment component comprise waterproof material.

12. The method of claim 8, wherein the label and the attachment component comprise coated paper.

* * * * *